United States Patent [19]

Rensner

[11] 4,422,281

[45] Dec. 27, 1983

[54] CONTAINER PACKAGE AND ITS MANUFACTURE

[75] Inventor: Jürgen G. Rensner, Philadelphia, Pa.

[73] Assignee: Pepsi Co., Inc., Purchase, N.Y.

[21] Appl. No.: 193,472

[22] Filed: Oct. 3, 1980

Related U.S. Application Data

[60] Continuation of Ser. No. 26,772, Apr. 3, 1979, Pat. No. 4,294,058, which is a continuation of Ser. No. 812,327, Jul. 1, 1977, abandoned, which is a division of Ser. No. 697,578, Jun. 18, 1976, Pat. No. 4,078,659.

[51] Int. Cl.[3] ..... B65B 61/14

[52] U.S. Cl. ..... 53/134

[58] Field of Search ..... 53/48, 134, 137, 413, 53/450; 493/88, 909; 156/251, 269, 522

[56] References Cited

U.S. PATENT DOCUMENTS

| | | | |
|---|---|---|---|
| 2,406,018 | 8/1946 | Irmscher | 53/413 |
| 2,575,580 | 11/1951 | Cadmus | 53/48 |
| 2,649,221 | 8/1953 | Wagner et al. | 53/137 |
| 2,869,438 | 1/1959 | Watson | 493/909 |
| 2,970,414 | 2/1961 | Rohdin | 53/559 |
| 2,982,400 | 5/1961 | Andre | 206/428 |
| 3,069,978 | 12/1962 | Hoeppner | 93/35 |
| 3,343,670 | 9/1967 | Stephan | 206/432 |
| 3,370,630 | 2/1968 | Haugh et al. | 150/12 |
| 3,481,107 | 12/1969 | Andblad et al. | 53/48 |
| 3,490,194 | 1/1970 | Monaghan | 53/450 |
| 3,540,186 | 11/1970 | Parvin et al. | 53/329 |
| 3,557,516 | 1/1971 | Brandt | 53/413 |
| 3,572,004 | 3/1971 | Carmichael | 53/587 |
| 3,834,970 | 9/1974 | Mitsjoka | 493/909 |
| 4,106,262 | 8/1978 | Aterianus | 53/450 |

FOREIGN PATENT DOCUMENTS

| | | | |
|---|---|---|---|
| 1184267 | 12/1964 | Fed. Rep. of Germany | 53/134 |
| 1382842 | 2/1972 | United Kingdom | 206/432 |

*Primary Examiner*—John Sipos

*Attorney, Agent, or Firm*—Bernard, Rothwell & Brown

[57] ABSTRACT

A thermoplastic film package having a plurality of tightly held articles, such as beverage bottles, is provided with a thermoplastic film handle and with an upper surface permitting opening of the package in a manner which facilitates removal of all or a portion of the articles from the package and return of articles to the package. The positions of attachment of the handle to the package in relation to the opened upper surface of the package enable the handle to assist in maintaining the integrity and usefulness of the package after it is opened, even though it is made of thin thermoplastic film. The opened package is thus suitable for carrying all or only a portion of the contents by using the handle. The end portions of the handle can be attached to the package by a process involving preliminary tacking and subsequent heating by contact with a hot gas in a film-shrinking operation. Secure attachment of the handle is obtained even though the contour of the area of the package to which the attachment is made is uneven and varies from one package to another in a given packaging operation.

17 Claims, 10 Drawing Figures

FIG. 8
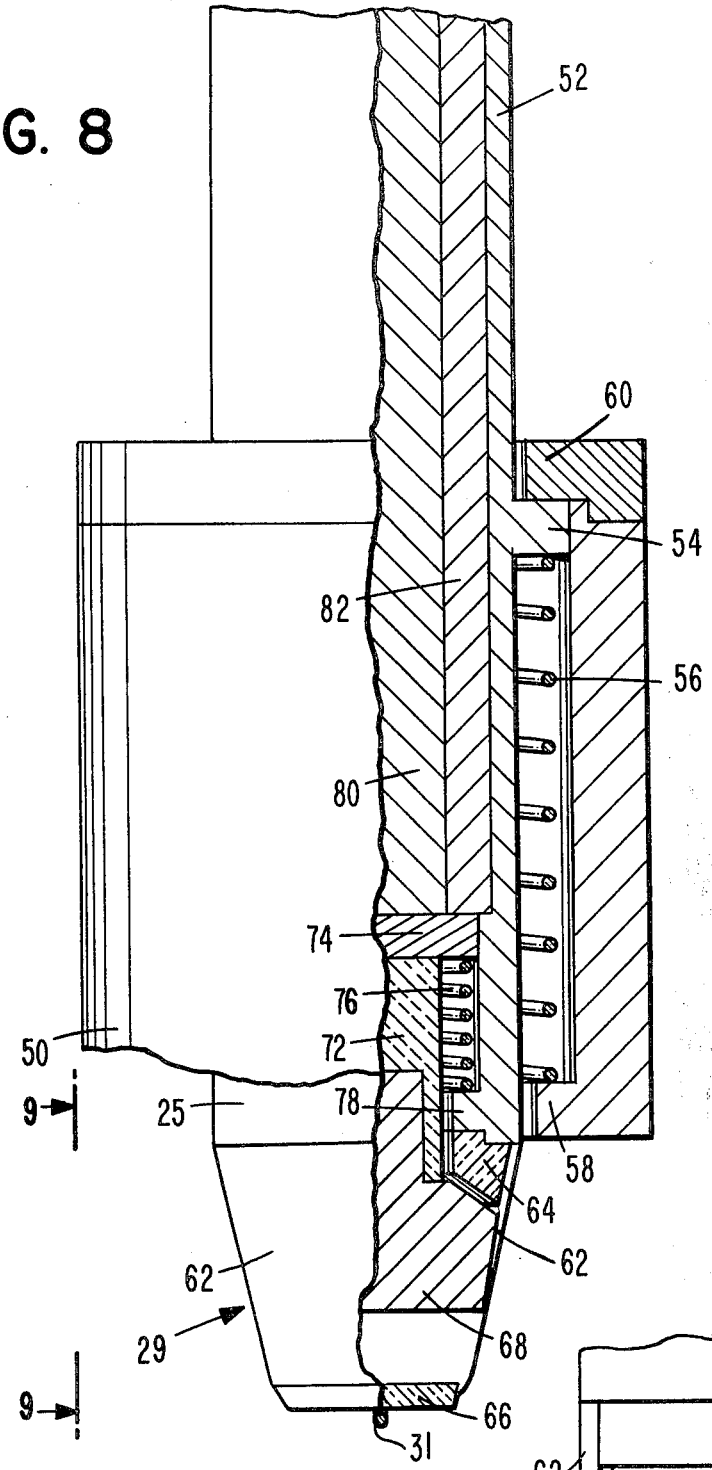
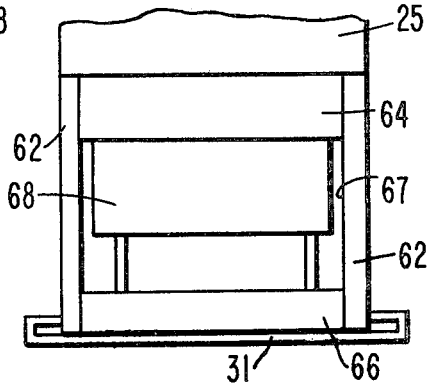
FIG. 9

CONTAINER PACKAGE AND ITS MANUFACTURE

This is a continuation of application Ser. No. 026,772, filed Apr. 3, 1979, now U.S. Pat. No. 4,294,058, which in turn is a continuation of application Ser. No. 812,327, filed July 1, 1977, abandoned, which in turn is a division of application Ser. No. 697,578, filed June 18, 1976, now U.S. Pat. No. 4,078,659.

The present invention pertains to the packaging of articles. More particularly, the present invention pertains to a package in which articles are tightly held by a thermoplastic wrapping film having a handle of thermoplastic film attached by its end portions to the package. The wrapping is preferably heat-shrunk to tightly enclose the articles. The package has an upper surface with a defined pattern of weakness permitting opening of the package without destroying the usefulness of the handle or the package. The positions of attachment of the handle to the package in relation to the opened upper surface of the package enable the handle to assist in maintaining the integrity and usefulness of the package after it is opened and even though it is made of thin thermoplastic film. The handle and opening cooperate in a manner facilitating removal of articles from and return of articles to the package while allowing the opened package to retain and transport all or a portion of the articles. The invention also relates to a method of and an apparatus for forming such a package. In a most advantageous form of the invention the end portions of the handle are attached to the package by a process involving preliminary tacking and subsequent heating by contact with a hot gas to seal the handle to the package. Secure attachment of the handle is obtained even though the contour of the area of the package to which the attachment is made is uneven and varies from one package to another in a given packaging operation.

Small articles are frequently packaged in groups for retail sale. By way of example, bottles or cans of beverages are frequently packaged in groups of two to eight or more bottles or cans. Fiberboard has been used to make cartons to hold a number of bottles or cans of beverage; however, such fiberboard cartons are expensive, both from the point of view of the material required and the labor or machinery involved in their manufacture. Additionally, should a fiberboard carton become wet, it may lose strength and no longer hold its articles. Beverage containers have been tightly packaged in a heat-shrunk thermoplastic, polymeric material such as polyethylene, polyvinylchloride, etc.; see, e.g. U.S. Pat. Nos. 3,525,428 and 3,557,947. While the thermoplastic polymeric material offers advantages in packaging, it has heretofore met with some consumer resistance for a variety of reasons. Once the heat-shrunk plastic film forming the package is opened and one or two containers removed from a package of, say, six beverage containers, the plastic may be easily torn to such an extent that the remaining containers are not securely held by the plastic wrapping, and movement of the opened package is difficult without more or less complete disintegration of the package. Also, as disclosed in the aforementioned U.S. patents, the heat-shrunk plastic packages often have only finger holes for carrying which may make carrying such a package difficult and cause premature opening and destruction of the package. In an attempt to overcome this problem, the aforementioned patents disclose, for example the inclusion of separate, more tear-resistant panels in the vicinity of the finger holes. This complicates the manufacturing process, with resultant economic disadvantages. Additionally, it may be desirable to use refillable containers for beverages such as reusable bottles, and previously known heat-shrunk packages which have been opened to permit removal of bottles have generally been unsuitable for securely holding the empty bottles for return.

The present invention concerns a package having a plurality of articles tightly held by a thermoplastic film positioned around the articles and the package is prvovided with a thermoplastic film handle that passes over an openable, upper surface of the package and whose end portions are attached to the package. The package, its handle and the attachment of one to the other are sufficiently strong so that the package can be used to transport a plurality of articles such as full beverage containers, and remain intact during storage and handling in the usual manner. Thus the package is very suitable not only for distribution, display and sale of the articles in the package, but also for transporting and storing the articles in the package during the period of their use or consumption of the contents of the articles when they are, for example, beverage containers. The package and its handle may also serve to make the package useful for return of the beverage containers when empty.

The package of this invention has the thermoplastic film handle in a location which serves to aid the maintenance of the usefulness and integrity of the package even after its upper surface is opened. Thus the handle extends along the top of the package and the end portions of the handle are attached to the package while a middle portion of the handle remains free and unattached to the package so that it may be easily grasped for carrying, but yet permit the movement of articles from or into the package. The upper surface of the package may be beneath an unattached middle portion of the handle and the attachments of the end portions of the handle to the package are located so that when the upper surface of the package is opened the handle inhibits further tearing of the film forming the package and consequent destruction of the package. Thus, even though the plastic package be opened and not be provided with any reinforcement around the formed opening, the position and attachment of the handle counteract the tendency for the film wrapping to tear and unduly enlarge the opening to the extent that the package would become virtually useless as a means for further handling and transporting of the articles in the package.

In the package of this invention the articles are tightly held in the package by the thermoplastic film wrapping, and due to the shape of the articles, the surfaces of the package to which the handle is attached in accordance with this invention often have contours which are uneven and may well vary from one package to another in a given production line. As a consequence the manner of attaching the handle to the package becomes significant, if the operation is to remain efficient and economically viable. Seals which must withstand considerable tensile force as in the present invention, are often formed by the application of pressure to the surfaces and, in the case of flexible materials, the use of a rigid support against which to apply the pressure. The latter type of operation would be difficult, if not impossible, to accomplish in making a package of the tape of this invention.

These difficulties can be overcome according to the present invention by attaching the end portions of the handle to the package by an initial tacking operation followed by further sealing through contact of the sealing area with a heated gas. Thus, the attachment of the end portions of the handle to the package is advantageously done in a plurality of stages, and preferably the initial tacking is performed by heat, e.g. by the application of a hot, solid surface to the tacking area. It is also preferred that the handle material undergo shrinkage in one or more of the stages, preferably during the contact with hot gas after tacking has occurred. In another aspect, the present invention is an apparatus for forming the package of the invention.

These and other aspects and advantages of the present invention are more apparent from the following detailed description, particularly when considered in conjunction with the accompanying drawings in which like parts bear like reference numerals. In the drawings:

FIG. 8 is an enlarged, fragmentary detail, partially sectional view of the portion of the apparatus depicted in FIG. 4 and showing the portion in its deactivated condition;

FIG. 9 is a fragmentary detail view taken along line 9—9 of FIG. 8.

The packaging of articles in heat-shrunk thermoplastic sheet material offers numerous advantages and is disclosed in several U.S. patents, e.g., U.S. Pat. Nos. 2,545,243, 3,087,610, 3,396,841, 3,545,165 and 3,557,516. Essentially, a layer of flexible, thermoplastic sheet or film material can be positioned around the tops and bottoms of the articles with two edges overlapping, and at or near the line of the initial overlap the sheet is heated to a temperature above the fusing or melting point of the thermoplastic sheet material to fuse the overlapped edges together. During or subsequent to the fusing any excess overlapping material may be cut or otherwise severed from the package. The thus relatively loosely wrapped package is then heated to a temperature below the melting temperature of the thermoplastic material but sufficiently elevated to shrink the sheet material tightly about the articles, thus tightly holding the articles within the sheet material. This heating can be done in an oven or shrinking tunnel, for example by passing the initially wrapped package through the shrinking tunnel on an endless conveyor.

Figure 1:
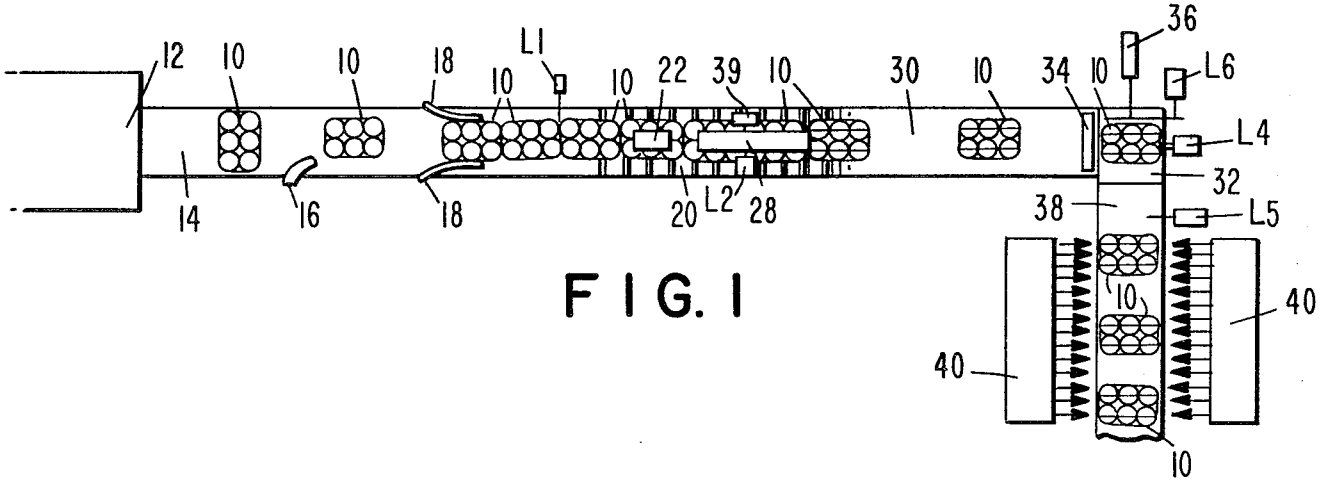
FIG. 1 is a plan view of apparatus for forming a package of containers in accordance with a preferred form of the present invention.
Figure 2:
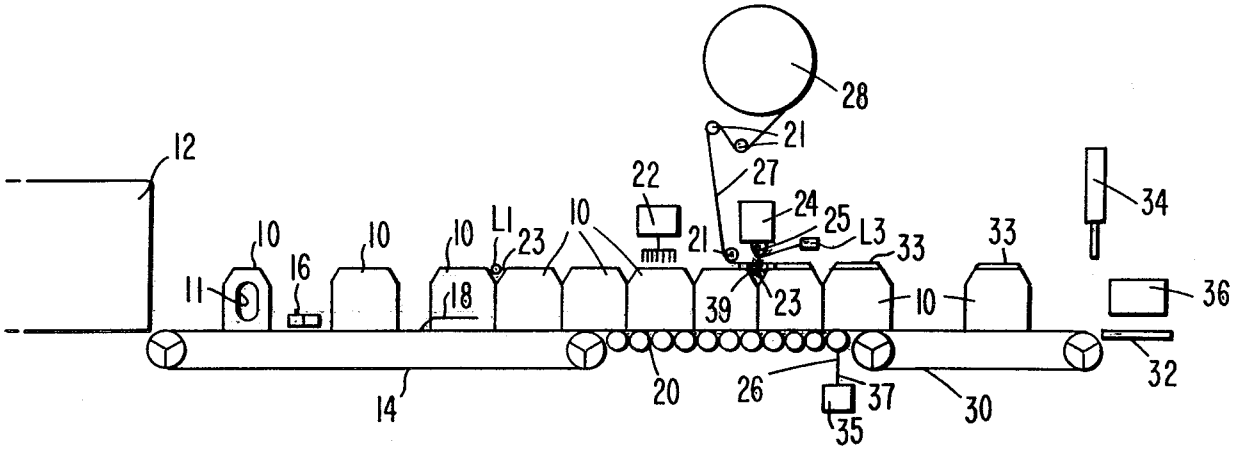
FIG. 2 is a side elevational view illustrating the apparatus of FIG. 1 but with some components omitted for clarity of illustration.

In accordance with the present invention as depicted in FIGS. 1 and 2, packages 10 of uniformly shaped articles, such as plastic beverage containers, which often have inwardly directed upper portions wrapped in a side-by-side position in a heat-shrunk thermoplastic sheet material emerge from shrinking tunnel 12 on conveyor 14 with the sheet material substantially enclosing and tightly shrunk about the articles to retain the articles as a package. As a result of this or other type of packaging the thermoplastic film wrapping is under tension and to add strength to the package this film can be molecularly oriented at least in the wrapping direction extending around the tops and bottoms of the upstanding containers. Conveyor 14 may be a conventional endless conveyor such as a continuously moving, table top chain conveyor. The sheet material of package 10 may be any suitable thermoplastic film material, for example a 2.5 mil high or low density, oriented polyethylene film. High density polytethylene film may be more subject to tearing and thus a package having this type of wrapping may particularly benefit by the present invention. Conveniently the sheet material may have a thickness of up to about ten mils or more, preferably from about one half or one to about four mils, and, to an extent at least, the sheet material thickness may depend upon the weight of the package contents. The sheet or film materials forming the package and the handle of the package are of wrapping thickness which is generally not sufficiently thick to be self-supporting of its own weight when in flat configuration and placed on any of its edges.

The thermoplastic films which may be used to provide the thermoplastic wrapping or the handle of the package of this invention include polymeric films made from one or more polymerizable monomers, and the films may be mono or biaxially molecularly oriented to improve their strength or other properties. Suitable films include those comprised of olefin polymers such as high density or low density polyethylene and polypropylene, e.g. isotactic polypropylene. Low density polyethylenes, which may include those of intermediate density, usually have densities of less than about 0.945 grams per cubic centimeter while high density polyethylenes often have densities above about 0.945 or at least about 0.95. Other thermoplastic films include those embodying vinyl polymers, e.g. polyvinyl chloride, copolymer or compounded polyacrylates or polymethacrylates or polyesters. The polymers may be in homopolymer or copolymer form as in the case, for instance, of copolymers of methyacrylonitrile or acrylonitrile and one or more of styrene and olefinically-unsaturated carboxylic acids such as acrylic acid and methacrylic acid. It is preferred that the wrapping and the handle of the package of this invention be made of heat-shrinkable thermoplastic film. The wrapping and handle films may be made of molecularly unoriented film, but it is preferred that the handle material be molecularly oriented at least in the general direction of the handle taken from one attached end portion to the other. It is also preferred that the handle be a low density polyethylene. The wrapping film is preferably molecularly oriented in at least the general direction of wrapping around the articles in the package. In a given package the handle may be the same or a different polymer compared with that constituting the wrapping around the containers in package 10. Both the handle and the package wrap may be films which upon momentary heating at a temperature in the order of about 300° F. experience substantial shrinkage, e.g. about 10 to 60%, or even about 30 to 60%. For example, the wrapping may shrink about 30% to about 60% in the wrapping direction, and the shrinkage in the transverse direction may be in the same range or less than the wrapping direction shrinkage, e.g. the transverse direction shrinkage may be about 10% to about 20%.

By way of illustrating an embodiment of the present invention, FIGS. 1 and 2 depict the packaging of six beverage bottles in each package 10, so that each package is rectangular, being two bottles wide and three bottles long. It is preferred that the package sides be at least as long as, if not longer than, the package ends and that the package have two rows of containers in one direction and two or more, say up to about 4 to 6, rows in the other direction. The packages 10 may emerge from shrinking tunnel 12 in any desired position, and as illustrated in FIGS. 1 and 2, the packages 10 emerge from shrinking tunnel 12 with their wider or longer side normal to the direction of movement. In such event, mechanical package turner 16 turns the packages to a position in which the narrower or shorter side is normal to the direction of movement of conveyor 14. Guide rails 18 assure that each package 10 is substantially entered on conveyor 14.

In a typical operation for forming packages of this type, as disclosed in the aforementioned U.S. patents, the sheet of plastic material encompasses the plurality of assembled containers which are to be within one package and whose sides are in contact, in a manner such that the sheet of plastic material is essentially parallel to the longer side dimension of the assembled containers or essentially parallel to either side if the sides are equal. Each side of the sheet extends somewhat beyond the respective end containers in the assembly e.g. extending beyond the end of the container a distance equal to at least about 10% of the package shorter dimension. During heating of a heat-shrinkable film the ends of the sheet sides shrink around the ends of the assembly to tightly hold the containers in position while usually leaving a gap or hole 11 which may be generally elliptical in shape at each end of the package as depicted in FIG. 2. The tight shrinking of the open ends of the package helps maintain the articles within the package during handling, and in acordance with the preferred form of the present invention the sheet material extends beyond the end containers to provide sufficient material for attachment of a handle.

From conveyor 14 the packages are discharged onto roller surface 20. The continued movement of the packages 10 on conveyor 14 causes the packages on the conveyor to push the packages along the length of support surface 20, even though roller surface 20 is not driven. This assumes that the consecutive packages on roller surface 20 are immediately next to each other.

In order to provide a weakened portion in the upper surface of the package and beneath the handle which is to be applied, perforator 22 having a plurality of perforating members in a defined pattern, e.g. in a line generally parallel to the handle, and tacking unit 24 can be positioned above roller surface 20. Braking device 26 is positioned to stop movement of the packages 10 along roller surface 20 so that each package is stopped in the desired position beneath perforator 22 and tacking unit 24. The weakened portion facilitates opening of the package is a more defined and conrollable pattern.

Figure 3:
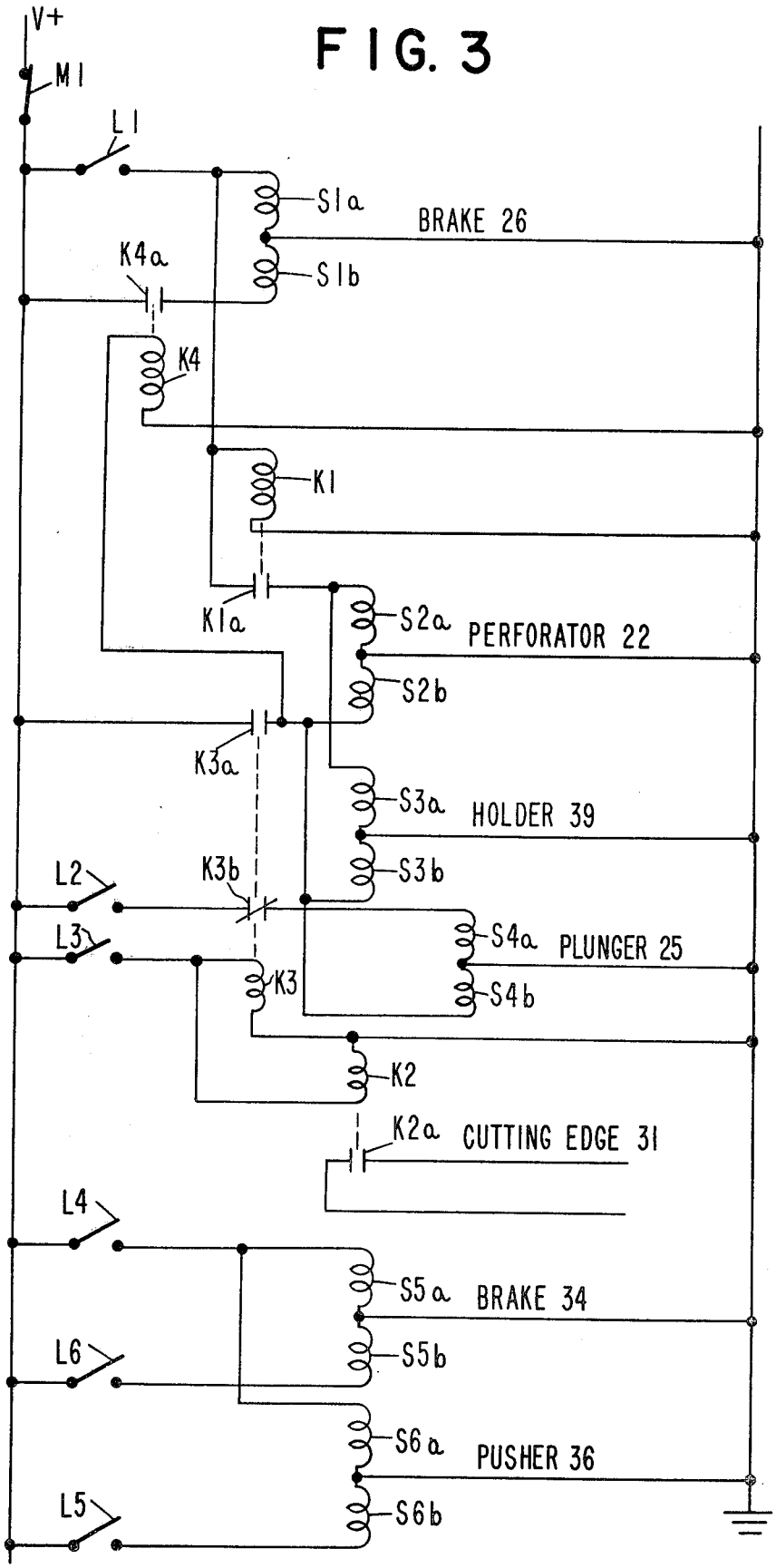
FIG. 3 is a schematic diagram of a control system for the apparatus of FIGS. 1 and 2.

A limit switch L1 is positioned to be actuated by packages 10 passing it as the packages move towards braking device 26. Referring to FIG. 3, a normally-closed manual override switch M1 is provided to permit disabling of the circuitry when desired, and with manual override switch M1 closed, actuation of limit switch L1 applies energy to solenoid coil S1*a* which actuates braking device 26. As seen in FIG. 2, braking device 26 includes a piston unit 35 coupled to the last roller 37 of roller surface 20. When limit switch L1 applies energy to solenoid coil S1*a*, piston unit 35 extends its plunger to raise roller 37. Consequently a package 10 then partially on roller 37 is raised and continues to move until it has transferred from roller surface 20 to endless conveyor 30, but the next package 10 is blocked from movement until roller 37 has returned to its lowered position of FIG. 2. The blocking of this package 10 by roller 37 stops movement of the packages 10 in the desired positions on roller surface 20. Once solenoid coil S1*a* has caused actuation of braking device 26, the braking device remains actuated with roller 37 raised until solenoid coil S1*b* is energized, even after limit switch L1 opens to remove excitation from solenoid coil S1*a*. Limit switch L1 is thus positioned so that each package 10 passing the limit switch actuates it to energize braking device 26, but when the movement of packages 10 is stopped by braking device 26 with a package 10 properly positioned beneath tacking unit 24 and the next package 10 properly positioned beneath perforator 22, limit switch L1 is deactivated, for example in the packaging of bottles by limit switch L1 then being at the depression 23 between two packages 10, as illustrated in FIG. 2.

The closing of limit switch L1 also energizes relay coil K1 which, after a time delay sufficient to assure that movement of the packages on roller surface 20 has stopped, closes its normally open contact K1*a*. Excitation then passes through limit switch L1 and contact K1*a* to energize solenoid coil S2*a* and solenoid coil S3*a*. Solenoid coil S2*a* actuates perforator 22 which perforates the thermoplastic sheet on the upper surface of the package 10 positioned beneath it to provide a portion of the film which is weaker than adjacent portions of the film. Perforator 22, by way of illustration, may be a group of sharpened rods or wires, resembling a comb or other defined pattern, which punches openings through the thermoplastic material of package 10 or otherwise weakens the thermoplastic material in the area of contact of each rod or wire to provide a perforation or weakened area or portion for opening package 10. The perforations or other means for weakening the sheet are formed in the top of the plastic packaging material and provide a place for easy access into the package. Generally, the weakened area is large enough to permit removal of a container from the package without tearing the sheet to any substantially greater extent beyond the weakened area. The weakened area, e.g. perforations, may extend along the top of the package, and preferably near the middle of the top. The weakened area may constitute a line or intersecting lines, which may be straight or curved, between the middle of the tops of the generally parallel line of containers in the package. The weakened area is, preferably, substantially beneath the handle for the package as provided by this invention.

Although the end portions of the handle may be attached to the package by various means, it is much preferred that this be done by heat-sealing. Reel 28 of thermoplastic handle material is positioned to feed the handle material in a continuous ribbon 27 about guide rollers 21 and between the extended tines 41 of a holder or fork 39 and the plunger 25 of tacking unit 24. The end of ribbon 27 has previously been tacked to the leading edge of the package 10 which is just emerging from beneath tacking unit 24. As seen from FIG. 4, in the packaging of beverage bottles, when the packages 10 are halted beneath tacking unit 24 and tines 41 are extended to a position beneath the handle line, a tine 41 is positioned adjacent the upper surface of the package 10 which is emerging from beneath tacking unit 24 and at the trailing edge of that upper surface, and the second tine 41 is positioned adjacent the upper surface of the next package 10 at the leading edge of that upper surface. Ribbon 27 is thus bent over each tine 41 without interference from the tops of the containers, thereby assuring a smooth, substantially ripple-free bend during tacking. Limit switch L2 detects the positioning of holder 39 with tines 41 so positioned.

Figure 4:
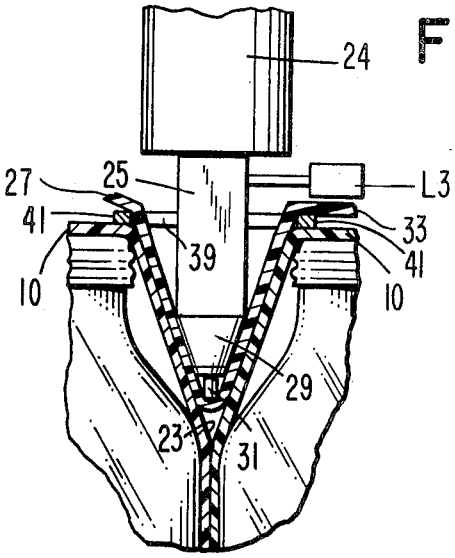
FIG. 4 is an enlarged, fragmentary view of a portion of the apparatus of FIGS. 1 and 2.

Plunger 25 is shaped to fit into the depression 23 between adjacent packages 10. Actuation of limit switch L2 energizes solenoid coil S4*a*, causing plunger 25 of tacking unit 24 to extend. Consequently, the ribbon 27 of handle material is urged downwardly by plunger 25 so that the ribbon 27 bends across tines 41 to contact the two packages 10 which embrace plunger 25. Limit switch L3 detects extension of plunger 25. As seen in FIG. 4, plunger 25 includes a tacking portion 29 and a cutting edge 31. As plunger 25 urges ribbon 27 into contact with the two packages 10, tacking portion 29 is heated to a temperature above the fusing or melting temperature of ribbon 27 and the plastic film which forms package 10. Tacking portion 29 is preferably constantly heated to the desired temperature but alternatively it may be heated upon actuation of limit switch L3, so long as the desired temperature is available upon contact of ribbon 27 against the two packages 10.

Cutting edge 31 may be a sharpened blade to mechanically sever ribbon 27 to separate the handles on adjacent packages 10. Cutting edge 31 may thermally sever ribbon 27. Thus, as illustrated in FIG. 3, when limit switch L3 is actuated by extension of plunger 25, the limit switch closes to energize relay K2, and so normally open contact K2*a* closes to provide energy to cutting edge 31. Cutting edge 31 then heats to a temperature sufficient to melt ribbon 27. Since the portion of ribbon 27 contacting cutting edge 31 is not in contact with package 10, ribbon 27 is thermally severed by the heated cutting edge 31 extending transversely across the ribbon, thus separating ribbon 27 with each severed end being unsealed in an area just below the tacking point of the handle. Accordingly, the package 10 which is just emerging from beneath tacking unit 24 has a portion of each end of a handle 33 tacked to it, while the next package 10 has one end portion of ribbon 27 tacked to its leading edge. Generally, the width of ribbon transverse to a line between the two attached points of the handle may be at least about 20%, preferably at least about 40%, of the width of the package taken in the same direction. The attachment of the end portions of the handle leaves the middle portion of the handle free from attachment to the package and thus provides a readily-grasped handle.

Closing of limit switch L3 also energizes relay K3 which, after a time delay sufficient to permit operation of perforator 22 and tacking unit 24, closes its normally open contact K3*a* to apply current to solenoid coils S2*b*, S3*b* and S4*b* and opens its normally closed contact K3*b* to cut off current to solenoid coil S4*a*. As set forth above, at this time limit switch L1 is opened, and so solenoid coils S2*a*, and S3*a* are likewise not energized. Therefore, solenoid coil S2*b* retracts perforator 22, solenoid coil S3*b* retracts holder 39, and solenoid coil S4*b* retracts plunger 25.

Current from relay contact K3*a* is also applied to the coil of time delay relay K4 which, after a delay sufficient to permit retracting of perforator 22, holder 39, and plunger 25, closes its normally open contact K4*a* to energize solenoid coil S1*b*, causing piston unit 35 of braking device 26 to lower roller 37. The retracting of plunger 25 causes limit switch L3 to open, removing excitation from relay coils K2 and K3. Relay K3 has a delay on drop-out sufficient to permit energization of relay coil K4 and lowering of roller 37 before contact K3*a* opens. Under the urging of conveyor 14, the packages 10 then move forward on both conveyor 14 and roller surface 20, and limit switch L1 again actuates braking device 26 and relay K1 to repeat the cycle.

From roller surface 20 the packages 10, with a handle 33 tacked to each, move onto endless conveyor 30, which can be of a construction similar to that of endless conveyor 14. Conveyor 30 transfers the packages 10, to stationary support surface 32. Limit switch L4 is positioned adjacent support surface 32 to detect the presence of a package 10 thereon. When limit switch L4 detects a package on support surface 32, it closes, applying current to solenoid coil S5*a*. This solenoid coil actuates brake 34 to extend its plunger which is adjacent the discharge of conveyor 30. Consequently, packages can no longer pass from conveyor 30 to support surface 32. The closing of limit switch L4 also applies current to solenoid coil S6*a* which energizes pusher 36 to transfer the package 10 from support surface 32 to endless conveyor 38. Limit switch L4 then opens, removing excitation from solenoid coils S5*a* and S6*a*. The presence of the package 10 on conveyor 38 is detected by limit switch L5 which closes its contact to apply current to solenoid coil S6*b*, retracting pusher 36. The return of pusher 36 to its retracted positioned is detected by limit switch L6 which closes its contact, applying current to solenoid coil S5*b* to retract brake 34. The next package 10 on conveyor 30 is then transferred to support surface 32 in front of pusher 36, and the operation repeats.

In the embodiment of the invention shown in FIGS. 1 and 2, conveyor 38 conveys the packages 10, with the handles 33 tacked thereon, past hot gas blowers 40 which blow hot gas, e.g., hot air, onto the two sides of each package 10 to increase the strength of the seal of the tacked handles 33 onto the packages. The areas near the ends of the handles 33 which are tacked to the plastic sheet of package 10 generally are partially or essentially completely surrounded by untacked areas. Upon subsequent heating, e.g. with a flow of hot gas such as air from blowers 40, the untacked areas of the handle around the tacked areas are preferable shrunk if a heat-shrinkable plastic is used for the handle, and such shrinking increases the thickness of the plastic in the tacked areas. Also, the area of each tack may be increased by the subsequent heating. These effects, coupled with the fact that the handle is preferably attached to a shrunk portion of the plastic covering of package 10, e.g. in the vicinity of the top of the opening 11 which is subtantially thicker than the original plastic material employed to form the package due to the shrinkage of the original plastic material as the package is formed, provides a strong connection of the handle to the package. Th handle may therefore be made of plastic films having thicknesses of the order stated above for the plastic covering around the containers of package 10, and it is preferred that the film used to make the handle be at least as thick as that employed in wrapping the containers.

It is advantageous, to use a heated gas for the further bonding to increase the strength of the tacked connections of the handle to the package, since the area of the shrunk package on which the tack is made may not be a flat surface and its shape may vary from package to package. The heated gas readily imparts its heating effect to the plastic regardless of the shape of the overall tacking area. Thus, it has been found that a package of this invention can effectively contain, for example, four, one-half gallon bottles of carbonated beverage, and the handle is quite serviceable in this instance.

EXAMPLES

To demonstrate the present invention, packages 10, each containing six, 32-ounce bottles made of polethylene terephthalate and filled with carbonated beverage, are wrapped in a 2.5 mil low density, 40% shrinkage polyethylene wrap molecularly oriented at least in the direction of wrapping. Each bottle has an upper neck portion the diameter of which is substantially smaller than that of the lower body of the bottle. The bottle sidewalls are sufficiently thick to be self-supporting. A handle 33 made of the same 2.5 mil low density, oriented, 40% shrinkage polyethylene three inches wide is attached to eack package 10 by tacking unit 24 using temperatures and tacking times as set forth in Table 1. The molecular orientation of the handle is at least in the direction from tack to tack.

TABLE 1

| Temp., °F. | Time, Sec. |
|---|---|
| 200 | 4 |
| 210 | 1 |
| 220 | 0.5 |
| 230 | 0.4 |

The operative tacking area of plunger 25 determines the area of the tack between the handle 33 and the package, and by way of example, this might be an area in the order of about one inch by two inches. This tack often cannot be relied upon to securely hold handle 33 to package 10, particularly if the contents of package 10 are relatively heavy, such as are substantially filled beverage bottles. A similar package can be made by replacing the low density polyethylene wrapping with a 1 mil. high density moleculary oriented polyethylene of about 40% shrinkage characteristics in both directions.

The further bonding by the hot gas from blowers 40 can be accomplished at a temperature sufficient to initiate melting of the handle and the wrap and for a time sufficient to result in bonding without melting the package to the point that the package is destroyed or the contents damaged. The duration of heating is, of course, related to the heating temperature, i.e. the higher the heating temperature, the shorter the heating time that may be used. The further bonding might be accomplished, for example, at a temperature is the range of from about 250° F. to about 425° F. or somewhat more. For packages similar to that in example above, satifactory bonding takes place with, for example, a hot gas temperature in the order of about 400° F. and a hot gas exposure time in the order of from about five to about seven seconds. The subsequent exposure to heat can increase the area of the sealed area significantly, e.g. by at least about fifty percent. For example, a one inch by two inch tack may be increased to a larger seal measuring about one-and-one-half inches by three inches having a tensile strength greater than that of the original material in either the handle or the shrunk package wrapping. The initially tacked area at each end of the handle may preferably be at least about one square inch, and after further heating the sealed area may preferably be at least about 2 square inches. These areas as well as the thicknesses of the wrapping and handle materials may depend on various factors such as the number and size of containers packages and the nature of the thermoplastic films employed. In any event the additional heating of the tacked ends of the handle 33 produces the desired seal without additional pressure. The additional treatment to further bond the handles may be done in various ways, but it is preferably done by heating. Even if done in this manner, hot gas blowers need not be used, and, by way of example, the heating could be accomplished by other suitable means such as infrared heaters. Also, if tacking unit 24 creates a sufficient tack for handling package 10 intact, then the additional bonding might be omitted.

Figure 7:
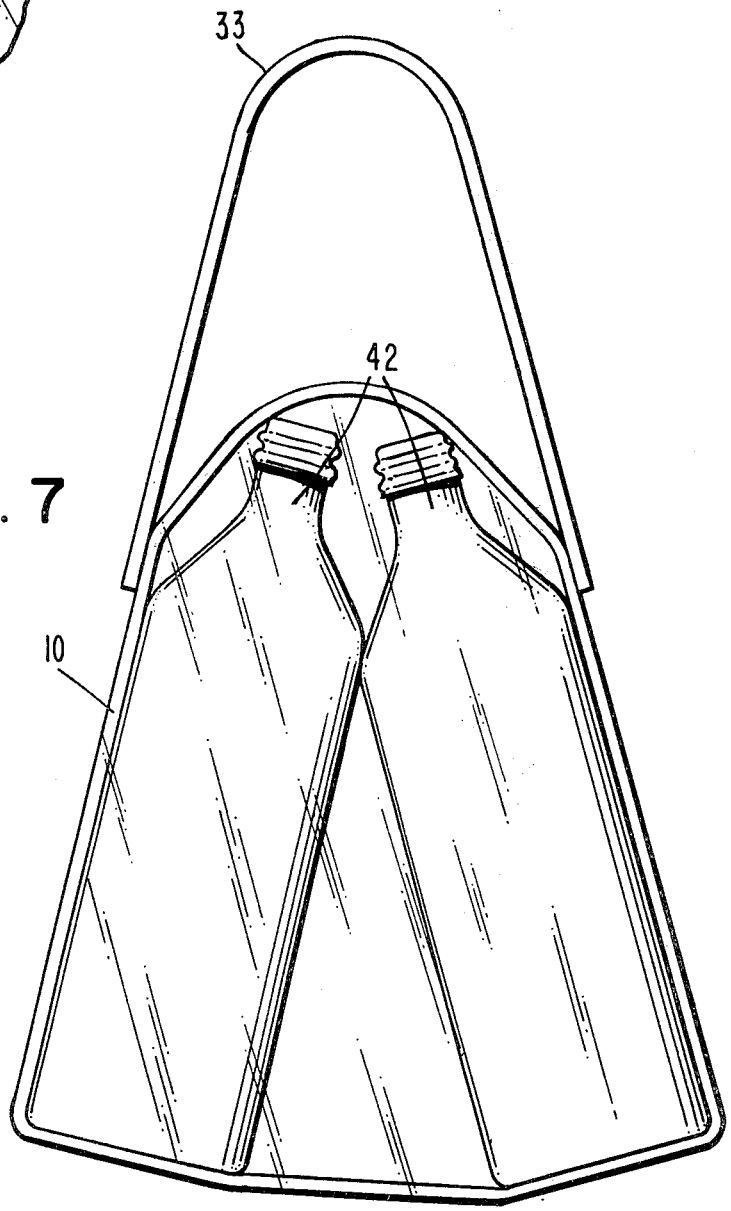
FIG. 7 is a side elevational view of the package of FIG. 6 illustrating the package with the middle portion of the articles removed therefrom.
Figure 5:
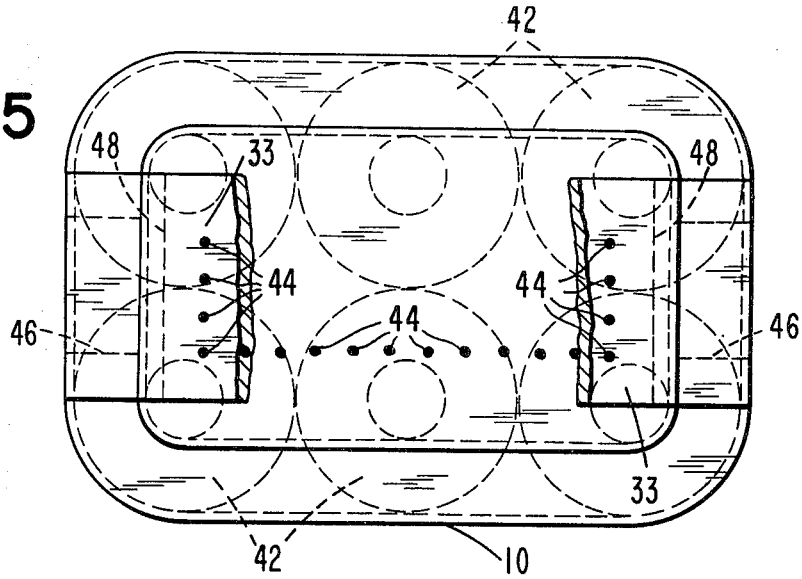
FIG. 5 is a plan view of a typical package formed in accordance with the present invention with the middle of the handle broken away.
Figure 6:
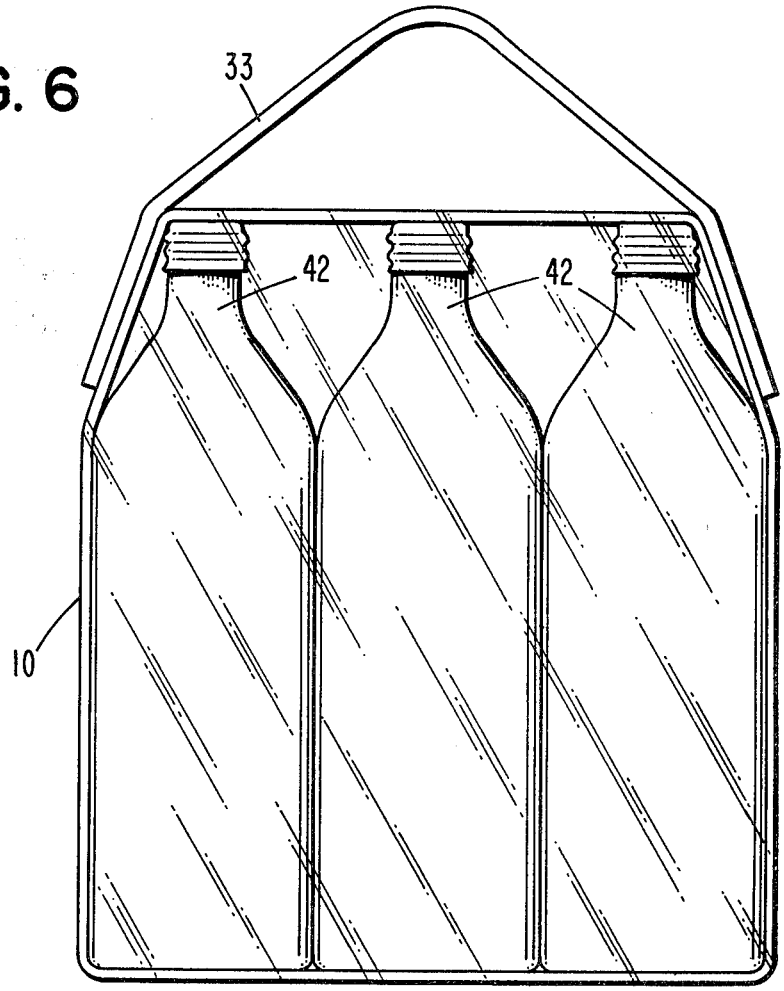
FIG. 6 is a side elevational view of the package of FIG. 5 illustrating the package filled with articles such as beverage bottles.

FIGS. 5 and 6 depict a typical package 10 illustrated as containing six thermoplastic plastic beverage bottles 42. Perforator 22 from perforations 44 in the upper surface of package 10 to permit easy opening of the package. A series of perforations 44 laid out in intersecting lines with a squared-U configuration is advantageous, preferably having the base of the U extending along a line adjacent the laterally inward edge of the tops or caps of the bottles 42, as depicted in FIG. 5. When a sufficient force is exerted on package 10 at perforations 44, the package tears more or less in a line defined by the perforations to provide an opening through which the bottles 42 can be removed. Plunger 25 initially tacks handle 33 at the areas 46 at either end of package 10, and after passage of the package 10 with handle 33 tacked thereto past hot gas blowers 40, the ends of handle 33 are shrunk and further sealed to the package even areas approximately indicated as areas 48. Due to shrinkage, areas 48 may have a lesser width than the end of the original film handle material employed and this may provide increased strength for the handle connection. The attached ends of the handle may also serve to stop the opened package from unduly tearing during carrying. The manner in which the package is opened and the fastening of handle 33 at each end of package 10 enable the package to retain bottles 42 within the package even though one or more of the bottles is removed from the package as depicted in FIG. 7. Also, the fastening of handle 33 at each end of package 10 enables use of the opened package to readily and effectively carry all or less than the full amount of bottles 42, as illustrated by FIGS. 6 and 7, and also the use of the package for carrying empty bottles for return for reuse.

FIG. 8 shows details of a preferred embodiment of tacking units 24, and in this position plunger 25 is withdrawn within housing 50. Plunger 25 includes an elongated hollow case 52 having a stop portion 54 extending circumferentially therearound within housing 50. Spring or biasing member 56 maintains plunger 25 withdrawn within housing 50, by the spring seting between lower surface 58 of housing 50 and stop portion 54 of case 52 to maintain stop portion 54 adjacent upper closure member 60 of housing 50. Upper heat insulating member 64 is connected to the lower end of case 52, e.g.

threadedly connected. Front and rear walls 62 connect upper heat insulating member 64 with lower heat insulating member 66. Front and rear walls 62 and insulating members 64 and 66 define a window 67 in each of the sidewalls of tacking portion 29 of plunger 25, as depicted in FIG. 9. Walls 62, by way of example, might be formed of a material of relatively low thermal conductivity, e.g. a rigid nylon material. Heating unit 68 is positioned within the cage formed by walls 62 and in the deactivated condition depicted in FIG. 8 is spaced from walls 62 and heat insulating members 64 and 66 by an air gap 70. Cutting edge 31 extends from heating unit 68 through lower heat insulating member 66 so as to be exposed beneath plunger 25. The upper end of heating unit 68 engages heat insulating member 72 which, in turn, is connected to upper member 74. Spring or biasing member 76 acts between lower edge 78 of case 52 and upper member 74 to retain heating unit 68 and cutting edge 31 in their retracted, deactivated position illustrated in FIG. 8. Rod 80 is connected to upper member 74 and is slidable within sleeve 82 which positions rod 80 within case 52. In the rest position depicted in FIG. 8, spring 56 is weaker than spring 76. Heating unit 68 and cutting edge 31 are coupled to suitable sources of energy by electrical conductors (not shown).

Figure 10:
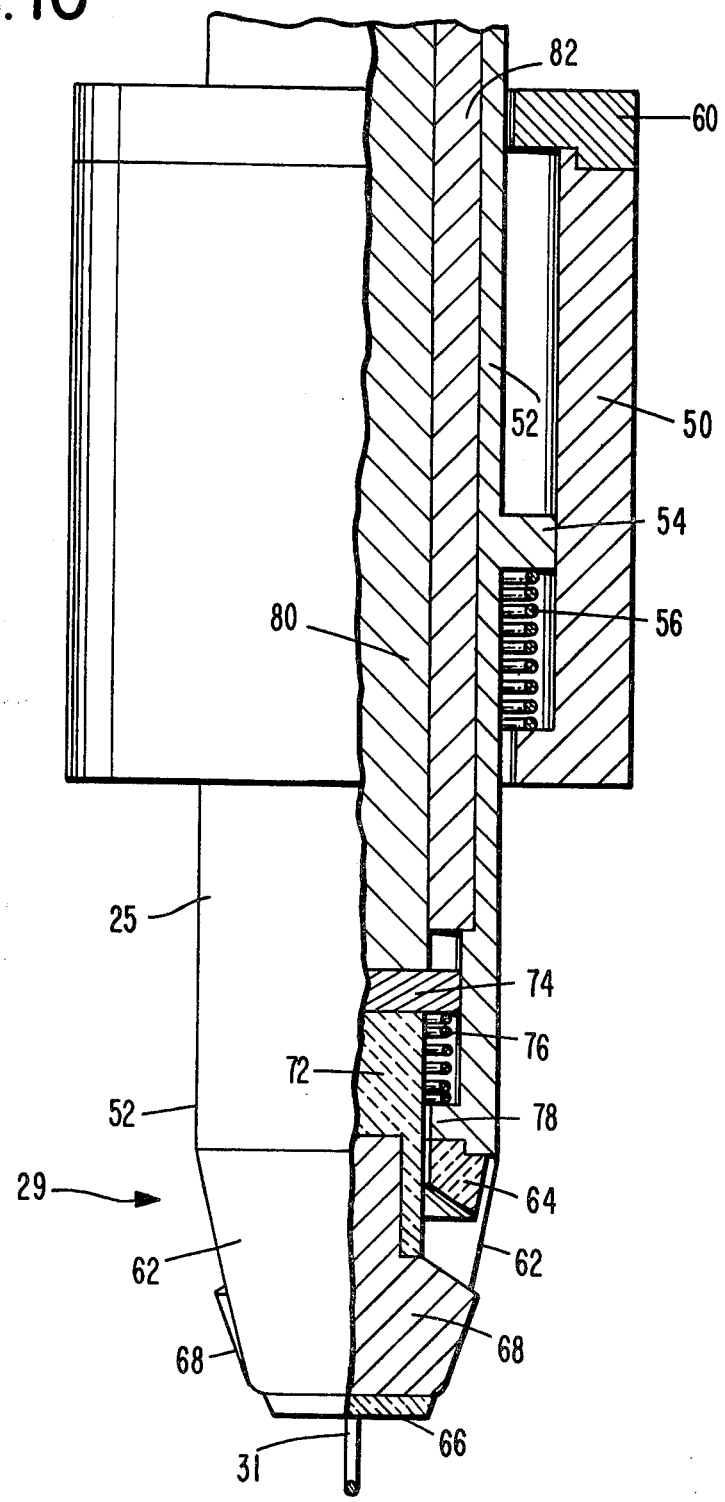
FIG. 10 is a view similar to FIG. 8 but showing the portion in its activated condition.

When limit switch L2 closes to energize solenoid coil S4*a*, the solenoid causes rod 80 to move downwardly, applying a downward force to spring 76. Because spring 76 is stronger than spring 56 in the rest position of FIG. 8, spring 76 acts against lower edge 78 to move case 52 downwardly against the bias of spring 56. As a result, plunger 25 extends downwardly from housing 50. Th side edges of walls 62 contact ribbon 27 to urge the ribbon into contact with the sides of the adjacent packages 10, and preferably this is accomplished before the heating surface contacts the handle film. When spring 56 is compressed to the point that spring 56 is of the same strength at spring 76, the continued downward movement of rod 80 causes both spring 56 and spring 76 to compress, continuing the downward movement of plunger 25 and moving heating unit 68 and cutting edge 31 downwardly within plunger 25. Heating unit 68 is shaped to extend out from the plunger 25 through windows 67. In the fully extended position of heating unit 68, the heating unit extends out windows 67 and cutting edge 31 extends out the end of plunger 25, as depicted in FIG. 10. In this position heating unit 68 contacts the ribbon 27 of handle material to urge ribbon 27 against the sides of the adjacent package 10. Likewise, in this fully extended position cutting edge 31 contacts ribbon 27 at the point at which ribbon 27 bridges the two adjacent packages 10, ribbon 27 at that point not being in contact with either of the adjacent packages 10. The sides of heating unit 68 which contact ribbon 27 are of a size and shape to correspond approximately to the area of the initial tack of the handle to the package wrapping, and cutting edge 31 extends completely across the handle material to be cut. Thus, once the force of spring 56 equals the force of spring 76, continued downward movement of rod 80 and upper member 74 causes heating unit 68 to contact ribbon 27 which is held firmly against the plastic material of the adjacent packages 10 and causes cutting edge 31 to extend to its operative position. The heat of continuously heated heating unit 68, which is formed of a material of high thermal conductivity, tacks ribbon 27 to each of the two adjacent packages 10. As described above, the extension of plunger 25 closes limit switch L3 to energize relay K2, causing contact K2*a* to close. Cutting edge 31 is then heated to thermally sever a completed handle 33 from ribbon 27.

The present invention has been described with reference to a preferred embodiment in which conveyor 38 runs in a direction different from that of conveyor 30, so as to reduce the length of the space required by the equipment. If appropriate space is available, conveyor 38 could be a continuation of conveyor 30, with surface 32, brake 34, pusher 36, and limit switches L4, L5 and L6 omitted.

Although the present invention has been described with reference to preferred embodiments, numerous substitutions, rearrangements and alterations could be made, and still the modifications would be within the scope of the invention.

What is claimed is:

1. Apparatus for attaching thermoplastic film handles to packages of articles wrapped in thermoplastic film comprising:

a source of thermoplastic ribbon-like handle film for forming successive handles each having handle end portions on opposite sides of a handle middle portion;

a support surface;

means for conveying packages of articles wrapped in thermoplastic wrap film on said support surface with said packages in end-to-end relationship;

means for positioning handle end portions of respective handles of the handle film from said source into contact with opposite non-supported side portions of the wrap films on each package of said packages on said support surface; said positioning means including means for positioning handle end portions into contact with adjacent side portions of each pair of adjacent packages of said packages, means for tacking the handle end portions of said handle film to the side portions of the wrap films on each of said packages leaving the middle portions of the handle film free of any tacking on each of said packages;

means for severing said handle film between the resulting tacked portions of said handle film between each pair of said adjacent packages; and heating means for heating said tacked handle end portions by hot gas or radiant energy to seal said handle end portions to the side portions of the wrap films of said packages leaving the middle portions of the handles free of any seal on each of said packages.

2. Apparatus as claimed in claim 1 in which said heating means is a source of hot gas.

3. Apparatus as claimed in claim 1 in which said tacking means includes means for heating areas of contact of said handle film with said packages.

4. Apparatus as claimed in claim 3 in which said heating means comprises a source of heated gas and means for conveying packages, each with a handle tacked thereto, past said source of heated gas to cause heated gas from said source to contact said packages and handles in the area of tack.

5. Apparatus as claimed in claim 4 in which said positioning means comprises a plunger member above said support surface with a space between said plunger member and the underlying packages on said support surface for passage of said handle film generally horizontally between said plunger member and said packages, and actuation means for extending said plunger member into contact with handle film on said path to urge said handle film into contact with the side portions of the wrap films on the two adjacent packages.

6. Apparatus as claimed in claim 5 in which said plunger member includes further heating means as said tacking means.

7. Apparatus as claimed in claim 6 in which said plunger member includes said severing means.

8. Apparatus as claimed in claim 5 in which said severing means comprises a cutting edge extending from the lower portion of said plunger member.

9. Apparatus as claimed in claim 5 in which said positioning means further comprises bar means having spaced-apart bars which permit passage of said plunger member when actuated to contact said handle film, said bars being positioned beneath said handle film when said plunger member is activated to contact said handle film and being moveable to positions of withdrawal from beneath said handle film after said tacking means has tacked said handle film to said two adjacent packages, said bar means serving to form a straight edge over which said handle film is smoothly positioned when tacked.

10. Apparatus as claimed in claim 1 in which said conveying means comprises a conveyor, means for sensing the position of packages on conveyor, and means responsive to said sensing means for stopping movement of packages on said conveyor when said two adjacent packages are positioned for tacking said handle film.

11. Apparatus as claimed in claim 7 in which said conveying means comprises a conveyor, means for sensing the position of packages on conveyor, and means responsive to said sensing means for stopping movement of packages on said conveyor when said two adjacent packages are positioned for tacking said handle film.

12. Apparatus as claimed in claim 11 in which said positioning means further comprises bar means having spaced-apart bars which permit passage of said plunger member when actuated to contact said handle film, said bars being positioned beneath said handle film when said plunger member is activated to contact said handle film and being moveable to positions of withdrawal from beneath said handle film after said tacking means has tacked said handle film to said two adjacent packages, said bar means serving to form straight edges over which said handle film is smoothly positioned when tacked.

13. Apparatus for attaching thermoplastic film handles to adjacent packages of articles tightly wrapped in thermoplastic film, said apparatus comprising:

(a) means for (1) positioning a first portion of thermoplastic handle film in contact with a first non-supported location on the thermoplastic wrapping of a first of said packages and (2) for positioning a second portion of said tacked film handle into contact with a second non-supported location on the thermoplastic wrapping of said first package and a first non-supported location on the thermoplastic wrapping of an adjacent, second one of said packages;

(b) means for (1) tacking said first portion to the thermoplastic wrapping of said first package at its first location and (2) tacking said second portion of said handle film to the thermoplastic wrappings of said first package at its second location and of said second package at its first location leaving free a middle portion of said handle film between said first and second portions of said handle film on said first package;

(c) means for severing said second portion of said handle film between the tacks on said first and second packages; and (d) means for heating said tacks by hot gas or radiant energy to increase the attachment of said first and second portions of said handle film to said packages.

14. An apparatus as claimed in claim 13 further comprising means for weakening the upper surface of the thermoplastic wrapping of said packages in a defined pattern to provide a weakened portion for opening said packages.

15. Apparatus for repeatedly attaching thermoplastic film handles to adjacent packages of a continuous series of packages having articles tightly wrapped in thermoplastic film, comprising:

(a) conveyor means for advancing said series of packages with a thermoplastic handle film tacked to said thermoplastic wrapping at a first location on a first side of a first of said series of packages;

(b) means for (1) contacting one portion of the thermoplastic handle film with a second non-supported location on said thermoplastic wrapping on an opposite side of said first package, and (2) contacting another portion of said thermoplastic handle film with a first non-supported location on said thermoplastic wrapping on a first side of a second of said packages;

(c) a heating device for (1) contacting said one portion of said handle film in contact with said opposite side of said first package to heat and tack said handle film to said first package thermoplastic wrapping at the location of said contact, while leaving an area of the one handle film portion adjacent the tack at least partially untacked, and (2) contacting said another portion of said handle film in contact with the thermoplastic wrapping on said first side of said second package to heat and tack said handle film to said second package thermoplastic wrapping at the location of said contact, while leaving an area of the another handle film portion adjacent the tack at least partially untacked;

(d) means for severing said handle film between said tacks on said opposite side of said first package and said first side of said second package; and (e) means for contacting said adjacent areas of the one and another portions of said thermoplastic handle film with heated gas to heat and increase attachment of said handle film to said packages.

16. An apparatus as claimed in claim 15 further comprising means for weakening the upper surface of the thermoplastic wrapping of said packages in a defined pattern to provide a weakened portion for opening said packages.

17. Apparatus for repeatedly attaching thermoplastic film handles to adjacent packages of a continuous series of packages having articles tightly wrapped in thermoplastic wrap film, said packages having an upper surface, comprising:

(a) conveyor means for advancing said series of packages with a thermoplastic handle film tacked to said thermoplastic wrapping at a first location on a first side of a first of said series of packages;

(b) means for providing a weakened portion in the upper surface of said thermoplastic wrap film for opening said packages;

(c) means for (1) contacting one portion of the thermoplastic handle film with a second location on said thermoplastic wrapping on an opposite side of said first package, and (2) contacting another portion of said thermoplastic handle film with a first location on said thermoplastic wrapping on a first side of a second of said packages;

(d) tacking means for (1) heating said one portion of said handle film in contact with said opposite side of said first package to tack said handle film to said first package thermoplastic wrapping at the location of said contact, while leaving an area of the one handle film portion adjacent the tack at least partially untacked, and (2) heating said another portion of handle film in contact with the thermoplastic wrapping on said first side of said second package to tack said handle film to said second package thermoplastic wrapping at the location of said contact, while leaving an area of the another handle film portion adjacent the tack at least partially untacked;

(e) means for severing said handle film between said tacks on said opposite side of said first package and said first side of said second package; and (f) means for heating said adjacent areas of the tacked portions of said thermoplastic handle film by heated gas or radiant energy to increase said attachment of said handle film to said packages.

* * * * *

UNITED STATES PATENT AND TRADEMARK OFFICE

CERTIFICATE OF CORRECTION

PATENT NO. : 4,422,281

DATED : December 27, 1983

INVENTOR(S) : Jurgen G. Rensner

It is certified that error appears in the above-identified patent and that said Letters Patent is hereby corrected as shown below:

Column 2, line 67, reads "tape", should read -- type --.
Column 4, line 34, after "include" insert -- various --.
Column 8, line 55, "preferable"; should read -- preferably --.
line 67, "Th"; should read -- The --.
Column 9, line 29, "eack"; should read -- each --.
Column 10, line 11, "packages"; should read -- packaged --.
line 25, "from"; should read -- forms --.
line 41, "even"; should read -- over --.
line 64, "seting"; should read -- acting --.
Column 11, line 33, "Th"; should read -- The --.

Signed and Sealed this

First Day of May 1984

[SEAL]

*Attest:*

GERALD J. MOSSINGHOFF

*Attesting Officer*

*Commissioner of Patents and Trademarks*